US005646088A

United States Patent [19]

Hada et al.

[11] Patent Number: 5,646,088

[45] Date of Patent: Jul. 8, 1997

[54] THERMOSENSITIVE RECORDING MATERIAL AND PRODUCTION PROCESS THEREOF

[75] Inventors: Kunihiko Hada; Yasutomo Mori; Motoi Orihara; Shuji Miyamoto, all of Numazu, Japan

[73] Assignee: Ricoh Co., Ltd., Tokyo, Japan

[21] Appl. No.: 600,903

[22] Filed: Feb. 15, 1996

[30] Foreign Application Priority Data

Feb. 16, 1995 [JP] Japan ..... 7-050342

[51] Int. Cl.[6] ..... B41M 5/30

[52] U.S. Cl. ..... 503/209; 427/150; 427/151; 427/152; 503/226

[58] Field of Search ..... 427/150, 151, 427/152; 503/209, 226

[56] References Cited

U.S. PATENT DOCUMENTS

| | | | |
|---|---|---|---|
| 4,181,771 | 1/1980 | Hanson et al. | 503/207 |
| 5,380,694 | 1/1995 | Krebs | 503/214 |

*Primary Examiner*—Bruce H. Hess
*Attorney, Agent, or Firm*—Oblon, Spivak, McClelland, Maier & Neustadt, P.C.

[57] ABSTRACT

A thermosensitive recording material having a high degree of background whiteness, superior light resistance without coloring of the background when exposed to the light, and a method of producing a stable coating liquid or forming a thermosensitive coloring layer and a protective layer are provided.

24 Claims, No Drawings

THERMOSENSITIVE RECORDING MATERIAL AND PRODUCTION PROCESS THEREOF

BACKGROUND OF THE INVENTION

1. Field of the Invention

The present invention relates to a thermosensitive recording material, and more particularly to an improved thermosensitive recording material having good preservability such as the light resistance of the recorded image and the background, and a high degree of background whiteness, and a production process thereof.

2. Discussion of the Background

Presently, a thermosensitive recording material, is known in which a thermosensitive coloring layer is provided on a substrate, such as a sheet of paper, synthetic paper, or plastic film. The thermosensitive coloring layer includes a colorless or pale-colored coloring agent, such as a leuco dye, a coloring developer for inducing color formation in the leuco dye upon application of heat thereto, such as a phenolic compound and organic acid, a binder, and, if necessary, a filler, a thermosensitizer, a lubricant, and auxiliary agents, which are mixed, dispersed, coated on a substrate, and dried to form a thermosensitive coloring layer. Such a thermosensitive recording material and production process have been disclosed in, for example, JP-P 43-4160, JP-P 45-14039 and JP-P 48-27736, and have been used for various purposes.

Since the thermosensitive recording image can be rapidly recorded by the chemical reaction of a coloring agent with a coloring developer, the thermosensitive recording process has the following advantages:

(1) images can be rapidly recorded by a relatively simple apparatus without complicated, steps, such as development and fixing;

(2) images can be recorded without producing noise and environmental pollution;

(3) various colored images, for example, red, blue, violet, and black, can be easily obtained; and (4) the manufacturing cost is low.

Because of these advantages, this type of thermosensitive recording material is widely used for price labels in stores. The thermosensitive recording material has wide-scale utilization not only as a recording material for price labels in stores, but also for copying documents and for printers for electric computer (CAD), facsimile machines, telex, ticket vendors, label printers for various industrial uses, and medical measuring instruments and the like.

However, the thermosensitive recording material has the shortcoming the recorded image easily fades away and the background area tends to color when the recorded image and the background area are exposed to sunlight or the light of a fluorescent lamp. This is caused by a change in the chemical composition of the recorded image or the coloring agent.

In an attempt to solve these problems, several proposals have been made. For example, JP-A 54-18752 discloses a thermosensitive recording material in which a benzophenolic ultraviolet stabilizer or a phenolic antioxidant is contained in the thermosensitive coloring layer including a coloring agent and a phenolic substance for inducing color formation in the coloring agent. JP-A 60-112487 discloses a thermosensitive recording material including a thermosensitive coloring layer, and a protective layer which is formed on a thermosensitive coloring layer and is included an ultraviolet stabilizer. JP-A 61-134292 discloses a thermosensitive recording material in which a thermosensitive coloring layer includes a pigment or dye absorbing the light in the region of 400 to 600 nm. JP-A 61-193883 discloses a thermosensitive recording material in which a protective layer includes a benzotriazol type ultraviolet stabilizer.

One problem which occurs, however, is that thermosensitive materials using an ultraviolet stabilizer in a thermosensitive coloring layer or a protective layer appear yellow or pale-yellow because the ultraviolet stabilizer tends to absorb light near 400 nm. To address this problem, it has been proposed that a fluorescent brightening agent be included in the thermosensitive coloring layer or that a protective layer for whitening be used. JP-A 62-184880 discloses a thermosensitive recording material having a protective layer including a diamino stilbene disulfonic acid type fluorescent brightening agent.

Another problem which occurs is that the preservability, such as the light resistance of the thermosensitive recording material, deteriorates. This is attributed to the fact that the ultraviolet stabilizer loses its ability to absorb ultraviolet rays by reaction with a fluorescent brightening agent. Furthermore, a fluorescent brightening agent increases the viscosity of the coating liquids forming the thermosensitive coloring layer and protective layer when they are prepared and coated.

Unfortunately, due to all of these reasons, a need exists for thermosensitive recording materials having both good preservability and high degree of background whiteness.

SUMMARY OF THE INVENTION

Accordingly, it is an object of the present invention to provide a thermosensitive recording material, which is able to maintain a high degree of background whiteness without unnecessary color development by light.

It is another object of the present invention to provide a method for producing a stable coating liquid for forming a thermosensitive coloring layer or a protective layer.

The above objects and others which will become apparent from the following description are provided by a thermosensitive recording material including a substrate, a thermosensitive coloring layer which is formed on the substrate by the steps of coating and drying an aqueous coating liquid containing a leuco dye and a coloring developer for inducing color formation upon application of heat thereto, and, when necessary, a protective layer which is formed on the thermosensitive coloring layer by the steps of coating and drying a coating liquid including an organic polymer, wherein an ultraviolet stabilizer including 2-(2-hydroxy-3-tert-butyl-5-methylphenyl)-5-chlorobenzotriazole represented by the following formula (I) and a fluorescent brightening agent including 4,4'-diamino stilbene-2,2'-disulfonic acid derivatives represented by the following formula (II) are included in at least one of the thermosensitive coloring layer and the protective layer.

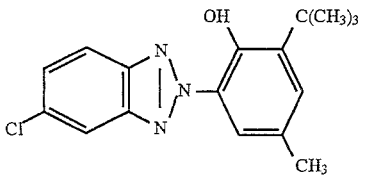

(I)

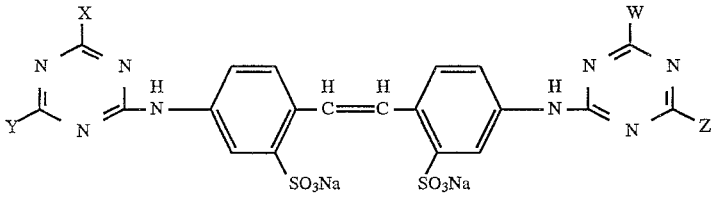

(II)

wherein X, Y, Z and W independently represent any of the substituents described below:

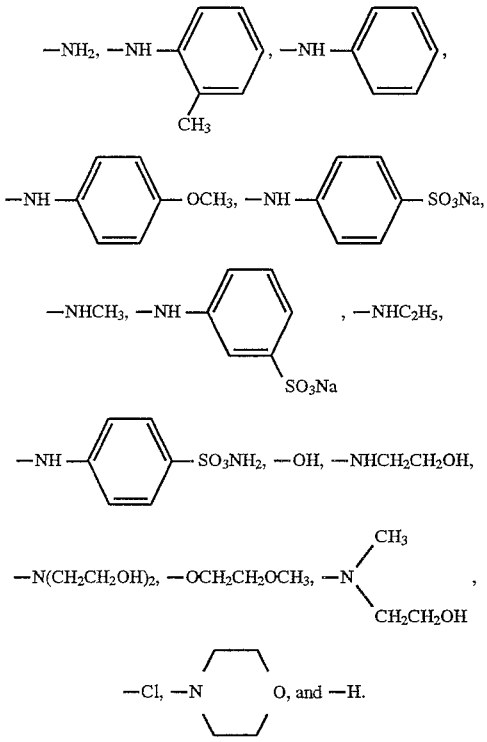

DESCRIPTION OF THE PREFERRED EMBODIMENTS

Quite surprisingly, in accordance with the present invention, a thermosensitive recording material with good preservability of the recorded image and the background of the recording material is provided, in part, by evaluating the structure, most suitable layer to be included, and the content to be added of ultraviolet stabilizers and fluorescent brightening agents. It has been discovered that only a formulation which includes an ultraviolet stabilizer including 2-(2-hydroxy-3-tert-butyl-5-methylphenyl)-5-chlorobenzotriazole and a fluorescent brightening agent, including one or more 4,4'-diamino stilbene-2,2'-disulfonic acid derivatives, in at least one of the thermosensitive coloring layer or the protective layer is able to solve the problems described above.

The present invention is also predicated upon the discovery that a thermosensitive coloring layer and a protective layer can be prepared without increasing viscosity or causing layer separation by including an ultraviolet stabilizer including 2-(2-hydroxy-3-tert-butyl-5-methylphenyl)-5-chlorobenzotriazole and/or a fluorescent brightening agent including 4,4'-diamino stilbene-2,2'-disulfonic acid derivatives in the coating liquids. Further, a stable coating is achieved with these coating liquids.

The first object of the present invention is achieved by a thermosensitive recording material including a substrate and a thermosensitive coloring layer, formed on the substrate, including a leuco dye, a coloring developer for inducing color formation in the leuco dye upon application of heat thereto, and an ultraviolet stabilizer including 2-(2-hydroxy-3-tert-butyl-5-methylphenyl)-5-chlorobenzotriazole and a fluorescent brightening agent including 4,4'-diamino stilbene-2,2'-disulfonic acid derivatives.

The first object of the present invention can also be achieved by a thermosensitive recording material including a substrate, a thermosensitive coloring layer, formed on the substrate, including a leuco dye, a coloring developer for inducing color formation in the leuco dye upon application of heat thereto, and a protective layer, formed on the thermosensitive coloring layer, including an organic polymer, wherein an ultraviolet stabilizer including 2-(2-hydroxy-3-tert-butyl-5-methylphenyl)-5-chlorobenzotriazole and a fluorescent brightening agent including 4,4'-diamino stilbene-2,2,-disulfonic acid derivatives are included in at least one of the thermosensitive coloring layer and the protective layer.

Furthermore, the first object of the present invention can be achieved by a thermosensitive recording material including a fluorescent brightening agent in an amount of less than 0.01 parts by weight per 1 part by weight of the leuco dye in the thermosensitive coloring layer and less than 0.01 parts by weight per 1 part by weight of the organic polymer in the protective layer.

The second object of the present invention can be achieved by a production method for producing a thermosensitive recording material by forming on a substrate a thermosensitive coloring layer by steps of coating and drying an aqueous coating liquid including a leuco dye, a coloring developer for inducing color formation in the leuco dye upon application of heat thereto, and a binder, wherein the coating liquid includes an ultraviolet stabilizer 2-(2-hydroxy-3-tert-butyl-5-methylphenyl)-5-chlorobenzotriazole and a fluorescent brightening agent comprising 4,4'-diamino stilbene-2,2'-disulfonic acid derivatives.

Furthermore, the second object of the present invention can be achieved by a production method for producing a thermosensitive recording material by forming on a substrate a thermosensitive coloring layer which is formed by the steps of coating and drying an aqueous coating liquid including a leuco dye, a coloring developer for inducing color formation in the leuco dye upon application of heat thereto, and a binder, and by forming on the thermosensitive coloring layer a protective layer which is formed by the steps of coating and drying a coating liquid including an organic polymer, wherein an ultraviolet stabilizer including 2-(2-hydroxy-3-tert-butyl-5-methylphenyl)-5-chlorobenzotriazole and a fluorescent brightening agent including 4,4'-diamino stilbene-2,2'-disulfonic acid derivatives are included in at least one of a thermosensitive coloring layer coating liquid or a protective layer coating liquid.

The preferable content of the ultraviolet stabilizer is from about 0.1 to 5 parts by weight, more preferably from about 0.2 to 2 parts by weight, per 1 part by weight of the leuco dye in the thermosensitive coloring layer, and from 0.01 to 1 part by weight, more preferably from about 0.1 to 0.5 parts by weight, per 1 part by weight of the organic polymer in the protective layer.

When the content of the ultraviolet stabilizer is less than the above-mentioned amounts, the light resistance of the thermosensitive recording material tends to worsen. However, when the content of the ultraviolet stabilizer is greater than the above-mentioned amounts, the thermosensitive recording material tends to yellow, i.e. form a yellow coloration.

The preferable content of a fluorescent brightening agent is an amount of less than about 0.05 parts by weight, more preferably less than 0.01 parts by weight, per 1 part by weight of the leuco dye in the thermosensitive coloring layer, and less than about 0.05 parts by weight, more preferably less than about 0.01 parts by weight, per 1 part by weight of the organic polymer in the protective layer.

When the content of the fluorescent brightening agent is more than the upper limit, the thermosensitive recording material tends to yellow, i.e. form a yellow coloration.

The ultraviolet stabilizer, 2-(2-hydroxy-3-tert-butyl-5-methylphenyl)-5-chlorobenzotriazole, is represented by the following formula (I):

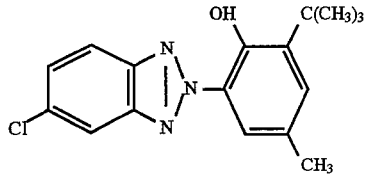

(I)

The fluorescent brightening agent, 4,4'-diamino stilbene-2,2'-disulfonic acid derivatives is represented by the following formula (II):

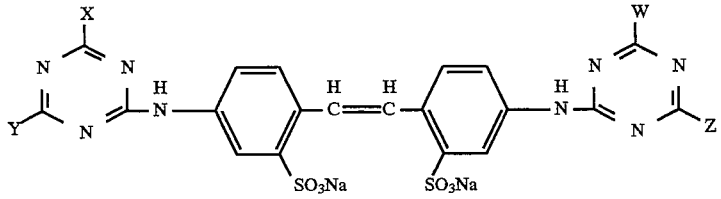

(II)

wherein X,Y,Z, and W independently represent any of the substituents described below.

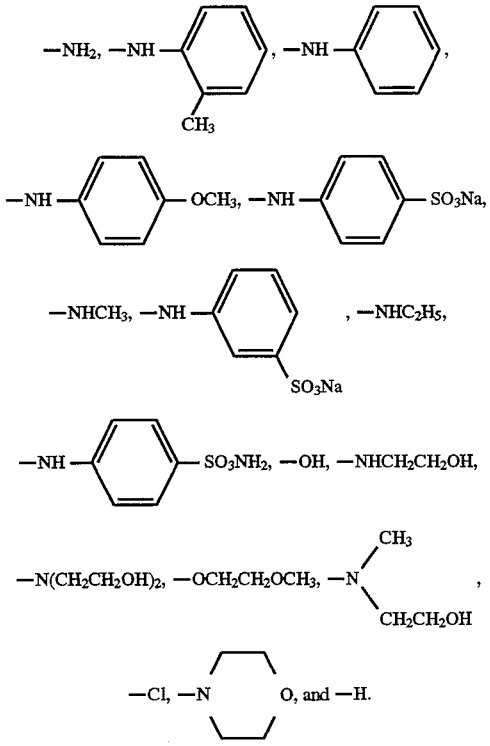

The combination of the ultraviolet stabilizer and the fluorescent brightening agent of the present invention are as follows:

| layer | 1 | 2 | 3 | 4 | 5 | 6 | 7 | 8 | 9 | 10 |
|---|---|---|---|---|---|---|---|---|---|---|
| protective layer | | | (I) (II) | (I) | (II) | (I) (II) | (I) (II) | (I) | (II) | (I) (II) |
| thermosensitive coloring layer | (I) (II) | (I) (II) | | (II) | (I) | (I) | (II) | (I) (II) | (I) (II) | (I) (II) |
| substrate | | | | | | | | | | |

As the leuco dye for use in the present invention, which may be employed individually or in combination, any known dye presently used in conventional thermosensitive recording materials can be employed. For example, triphenylmethane-type leuco compounds, fluoran-type leuco compounds, phenothiazine-type leuco compounds, auramine-type leuco compounds, spiropyrantype leuco compounds, indolinophthalide-type leuco compounds are preferably employed.

Specific examples of those leuco dyes are as follows:

3,3-bis(p-dimethylaminophenyl)phthalide, 3,3-bis(p-dimethylaminophenyl)-6-dimethylaminophtalide (or Crystal Violet Lactone), 3,3-bis(p-dimethylaminophenyl)-6-diethylaminophtalide, 3,3-bis(p-dimethylaminophenyl)-6-chlorophtalide, 3,3-bis(p-dibutylaminophenyl)phtalide, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-benzfluoran, 3-diethylamino-6-methyl-7-chlorofluoran, 3-(N-p-tolyl-N-ethylamino)-5-methyl-7-anilinofluoran, 3-pyrrolidino-6-methyl-7-anilinofluoran, 2-[N-(3'-trifluoromethylphenyl)amino]-6-diethylaminofluoran, 2-[3,6-bis(diethylamino)-9-(o-chloroanilino)xanthyl]-benzoic acid lactam, 3-diethylamino-6-methyl-7-(m-trichloromethylanilino) fluoran, 3-diethylamino-7-(o-chloroanilino) fluoran, 3-di-n-butylamino-7-(o-chloroanilino) fluoran, 3-(N-methyl-N-n-amylamino)-6-methyl-7-anilinofluoran, 3-(N-methyl-N-cyclohexylamino)-6-methyl-7-anilinofluoran, 3-diethylamino-6-methyl-7-anilinofluoran, 3-(N,N-diethylamino)-5-methyl-7-(N,N-dibenzylamino) fluoran, benzoyl leuco methylene blue, 6'-chloro-8'-methoxy-benzoindolino-spiropyran, 6'-bromo-3'-methoxy-benzoindolino-spiropyran, 3-(2'-hydroxy-4'-dimethylaminophenyl)-3(2'-methoxy-5'-chlorophenyl)phthalide, 3-(2'-hydroxy-4'-dimethylaminophenyl)-3-(2'-methoxy-5'-nitrophenyl)phtalide, 3-(2'-hydroxy-4'-diethylaminophenyl)-3(2'-methoxy-5'-methylphenyl)phtalide, 3-(2'-methoxy-4'-dimethylaminophenyl)-3-(2'-hydroxy-4'-chloro-5'-methylphenyl)phtalide, 3-(N-ethyl-N-tetrahydrofurfurylamino)-6-methyl-7-anilinofluoran, 3-(N-ethyl-N-2-ethoxypropylamino)-6-methyl-7-anilinofluoran, 3-N-methyl-N-isobutyl-6-methyl-7-anilinofluoran, 3-morphorino-7-(N-propyl-trifluoromethylanilino) fluoran, 3-pyrrolidino-7-m-trifluoromethylanilinofluoran, 3-diethylamino-5-chloro-7-(N-benzyl-trifluoromethylanilino)fluoran, 3-pyrrolidino-7-(di-p-chlorophenyl)methylaminofluoran, 3-diethylamino-5-chloro-7-(α-phenylethylamino) fluoran, 3-(N-ethyl-p-toluidino) -7-(α-phenylethylamino) fluoran, 3-diethylamino-7-(o-methoxycarbonylphenylamino) fluoran, 3-diethylamino-5-methyl-7- (α-phenylethylamino) fluoran, 3-diethylamino-7-piperidinofluoran, 2-chloro-3-(N-methyltoluidino)-7-(p-n-butylanilino) fluoran, 3-(N-methyl-N-isopropylamino)-6-methyl-7-anilinofluoran, 3-di-n-butylamino-6-methyl-7-anilinofluoran, 3,6-bis(dimethylamino)fluorenespiro(9,3')-6'-dimethylaminophtalide, 3-(N-benzyl-N-CyClohexylamino)-5,6-benzo-7-α-naphtylamino-4'-bromofluoran, 3-diethylamino-6-chloro-7-anilinofluoran, 3-diethylamino-6-methyl-7-mesidino-4', 5'-benzofluoran, 3-N-methyl-N-isopropyl-6-methyl-7-anilinofluoran, 3-N-ethyl-N-isoamyl-6-methyl-7-anilinofluoran, and 3-diethylamino-6-methyl-7-(2', 4'-dimethylanilino) fluoran.

As the coloring developer for use in the present invention, any conventional electron acceptor or oxidizing agent which works upon the above-mentioned leuco dyes to induce color formation can be employed.

Specific examples of such color developers are as follows:

4,4'-isopropylidenediphenol, 4,4,'-isopropylidenebis(o-methylphenol), 4,4,'-sec-butylidenebisphenol, 4,4,'-isopropylidenebis(2-tert-butylphenol), zinc p-nitrobenzoate, 1,3,5-tris(4-tert-butyl-3-hydroxy-2,6-dimethylbenzyl) isocyanuric acid, 2,2-(3,4,'-dihydroxydiphenyl)propane, bis(4-hydroxy-3-methylphenyl)sulfide, 4-[β-(p-methoxyphenoxy)ethoxy]salicylate, 1,7,bis(4-hydroxyphenylthio)-3,5-dioxaheptane, 1,5-bis(4-hydroxyphenylthio)-5-oxapentane, monocalcium salts of monobenzylphtalate, 4,4,'-cyclohexylidenediphenol, 4,4,'-isopropylidenebis(2-chlorophenol),
2,2,'-methylenebis(4-methyl-6-tert-butylphenol),
4,4,'-butylidenebis(6-tert-butyl-2-methylphenol),
1,1,3-tris(2-methyl-4-hydroxy-5-tert-butylphenyl)butane,
1,1,3-tris(2-methyl-4-hydroxy-5-cyclohexylphenyl) butane,
4,4,'-thiobis(6-tert-butyl-2-methylphenol),
4,4'-diphenolsulfone,
4-isoproxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
stearyl gallate,
lauryl gallate,
octyl gallate,
1,3-bis(4-hydroxyphenylthio)propane,
N,N'-diphenylthiourea,
N,N'-di(m-chlorophenyl)thiourea,
salicylanilide,
bis(4-hydroxyphenyl)methyl acetate,
bis (4-hydroxyphenyl)benzyl acetate,
1,3-bis(4-hydroxycumyl)benzene,
1,4-bis(4-hydroxycumyl)benzene,
2,4'-diphenolsulfone,
2,2,-diallyl-4,4'-diphenolsulfone,
3,4-dihydroxyphenyl-4'-methyldiphenylsulfone,
zinc 1-acetyloxy-2-naphthoate,
zinc 2-acetyloxy-1-naphthoate,
zinc 2-acetyloxy-3-naphthoate,
α,α-bis (4-hydroxyphenyl)-α-methyltoluene, antipyrine complex of zinc thiocyanate,
tetrabromobisphenol A,
tetrabromobisphenol S,
4,4,'-thiobis(2-methylphenol),
4,4,'-thiobis(2-chlorophenol),
o-(benzenesulfonylaminocarbonyl) benzoic acid methyl ester,
o-(benzenesulfonylaminocarbonyl)benzoic acid ethyl ester,
4,4'-bis(ptoluenesulfonylaminocarbonylamino) diphenylmethane,
4,4,'-bis(p-toluenesulfonylaminocarbonylamino) diphenylsulfide,
4,4,'-bis(p-toluenesulfonylaminocarbonylamino) diphenylether,
3,4,'-bis(p-toluenesulfonylaminocarbonylamino) diphenylether,
1,2-bis(4-(p-toluenesulfonylaminocarbonylamino) phenyl)ethane, and
2,8-dimethyl-3,7-(p-toluenesulfonylaminocarbonylamino) dibenzothiophenyl-5,5-dioxide.

A variety of conventional binders can be employed for binding the above-mentioned leuco dyes and coloring developers to a substrate of the thermosensitive recording material of the present invention.

Specific examples of the binders are as follows;

(water soluble polymers)
polyvinyl alcohol,
carboxy-modified polyvinyl alcohol,
starch and starch derivatives,
cellulose derivatives such as methoxycellulose, hydroxyethylcellulose, carboxymethylcellulose, methylcellulose, and ethylcellulose,
sodium salts of polyacrylic acid,
polyvinylpyrrolidone,
acrylamide-acrylate copolymer,
acrylamide-acrylate-methacrylic acid copolymer,
alkali salts of styrene-maleic anhydride copolymer,
alkali salts of isobutylene-maleic anhydride copolymer,
polyacrylamide,
sodium alginate,
gelatin, and
casein,
(emulsion)
styrene-butadiene copolymer,
styrene-butadiene-acrylate copolymer,
polyvinyl acetate,
vinyl acetate-acrylic acid copolymer,
styrene-acrylate copolymer,
polyurethane,
polyacrylate,
polymethacrylate,
vinyl chloride-vinyl acetate copolymer, and
ethylene-vinyl acetate copolymer.

Moreover, when necessary, the auxiliary components which are used in the conventional thermosensitive recording materials such as a filler, a thermofusible material, and a surface active agent can be added to the thermosensitive coloring layer.

Specific examples of the filler are finely-pulverized particles of inorganic fillers such as calcium carbonate, silica, zinc oxide, titanium dioxide, aluminum hydroxide, zinc hydroxide, barium sulfate, clay, talc, surface-treated calcium carbonate, surface-treated silica, and finely-divided particles of organic fillers such as urea-formaldehyde resin, styrene-methacrylic acid copolymer, and polystyrene resin.

Specific examples of the thermofusible materials are thermofusible compounds with a melting point ranging from about 50° to 200° C., such as higher fatty acid and esters, amide and metallic salts thereof, a variety of waxes, condensates of aromatic carboxylic acid and amines, phenyl benzoate, higher linear glycol, 3,4-epoxy-dialkyl hexahydrophtalate, higher ketone and p-benzylbiphenyl.

The formation of the thermosensitive coloring layer of the present invention can be achieved by the steps of preparing a coating liquid, coating the liquid on a substrate, and drying the coated liquid. The coating liquid can be prepared by mixing and dispersing in water a leuco dye, a coloring developer, a binder, and both or one of the ultraviolet stabilizer 2-(2-hydroxy-3-tert-butyl-5-methylphenyl)-5-chlorobenzotriazole and the fluorescent brightening agent 4,4'-diamino stilbene-2,2'disulfonic acid derivatives with auxiliary components when necessary.

The thermosensitive recording material may further include a protective layer which is provided on the thermosensitive coloring layer in order to improve the resistance to plasticizers and oils. A variety of organic polymers which are used in the conventional thermosensitive recording materials can be employed for the protective layer of the present invention.

Specific examples of organic polymers which may be used are as follows: water soluble resins such as polyvinyl alcohol, carboxymodified polyvinyl alcohol, amino-modified polyvinyl alcohol, epoxy-modified polyvinyl alcohol, starch and starch derivatives, cellulose derivatives such as methoxycellulose, hydroxyethylcellulose, carboxymethylcellulose, methylcellulose, ethylcellulose, polyacrylic acid and derivatives thereof, styrene-acrylic acid copolymer and derivatives thereof, poly(meth)acrylamide and derivatives thereof, styrene-acrylic acid-acrylamide copolymer, polyethylene imine, aqueous polyester, aqueous polyurethane, isobutylene-maleic anhydride copolymer and derivatives thereof, polymer emulsions such as polyester, polyurethane, acrylic acid copolymer, styrene-acrylate copolymer, epoxy resin, polyvinyl acetate, polyvinylidene chloride, polyvinyl chloride and derivatives thereof. Among these resins, the water-soluble resins are preferable for use in the protective layer in the present invention to improve the resistance of the colored image to plasticizer and oils.

Furthermore, the protective layer preferably includes waterproof agents which react with a water-soluble resin to produce a waterproof protective layer.

Examples of waterproof agents which may be used are as follows: formaldehyde, glyoxal, chrome alum, melamine, melamineformaldehyde resin, polyamide resin, and polyamide-epichlorohydrin resin.

The protective layer may further include auxiliary agents to prevent sticking to a thermal print head which is a most popular printing device of thermal printers, or coloring by pressure application. The auxiliary agents are such as a filler, a thermofusible material, a lubricant, a surface active agent, and an agent to prevent coloring by pressure application.

The aforementioned examples of the fillers or the thermofusible materials in the thermosensitive coloring layer can be also used for the protective layer.

The protective layer may be formed by one or more than two layers in the present invention.

The formation of the protective layer in the thermosensitive recording materials of the present invention can be made by preparing a coating liquid, coating the liquid on the thermosensitive coloring layer of the present invention, and drying the coated liquid. The coating liquid can be prepared, for example, by mixing and dispersing in water a water-soluble resin, and both or one of the ultraviolet stabilizer 2-(2-hydroxy-3-tert-butyl-5-methylphenyl)-5-chlorobenzotriazole and the fluorescent brightening agent 4,4'-diamino stilbene-2,2'-disulfonic acid derivatives with a water-proof agent, a filler, a thermofusible material, a lubricant, a surface active agent, and an agent to prevent coloring by pressure application, when necessary.

In the thermosensitive recording material of the invention, an intermediate layer may be interposed between the thermosensitive coloring layer and the protective layer. It is preferable that the intermediate layer for use in the present invention includes the previously mentioned materials in the protective layer.

Other features of this invention will come apparent in from the following description of exemplary embodiments, which are provided solely for purposes of illustration and are not intended to be limitative.

EXAMPLES

Example 1

(Formation of thermosensitive coloring layer)

A mixture of the following compounds was individually pulvalized and dispersed in a sand grinder in order that the average particle diameter of each liquid became below 2 μm, so that a Liquid A, a Liquid B, and a Liquid C were prepared:

| | parts by weight |
|---|---|
| (Liquid A) | |
| 3-di-n-butylamino-6-methyl-7-anilinofluoran | 20 |
| 10% aqueous solution of polyvinyl alcohol | 20 |
| water | 60 |
| (Liquid B) | |
| 4,4'-isopropylidenediphenol | 10 |
| 10% aqueous solution of polyvinyl alcohol | 25 |
| calcium carbonate | 15 |
| water | 50 |
| (Liquid C) | |
| 2-(2-hydroxy-3-tert-butyl-5-methylphenyl)-5-chlorobenzotriazol (component (I)) | 20 |
| 10% aqueous solution of polyvinyl alcohol | 20 |
| water | 60 |

The liquid A, liquid B, liquid C, and 1% aqueous solution of the fluorescent brightening agent, 4,4'-diamino stilbene-2,2'-disulfonic acid derivatives (BLANKOPHOR Z-PSG, manufactured by Bayer Japan) were mixed with stirring at a weight ratio of 1:8:1:0.4, so that a thermosensitive coloring layer coating liquid was obtained. The thermosensitive coloring layer coating liquid was coated on a sheet of commercially available woodfree paper with a basis weight of 50 g/m$^2$, serving as a substrate, in a coating amount of 7 g/m$^2$ on a dry basis, and dried, resulting in a thermosensitive coloring layer on the substrate.

(Formation of protective layer)

The following components were mixed to prepare a coating liquid D for a protective layer;

| (Liquid D) | parts by weight |
|---|---|
| 10% aqueous solution of polyvinyl alcohol | 63 |
| polyamide-epichlorohydrin resin (solid content 25%) | 10 |
| silica | 3 |
| zinc stearate | 1 |
| water | 23 |

The above-prepared coating liquid D was coated on the above prepared thermosensitive coloring layer in a coating amount of 5 g/m$^2$ on a dry basis, and dried, so that a protective layer was formed on the thermosensitive coloring layer. Furthermore, the surface of the prepared protective layer was subjected to calendering under the condition of a pressure of 35 kg/cm$^2$ so as to have a smooth surface. Thus, a thermosensitive recording material of the present invention was obtained.

Example 2

The procedure for preparation of the thermosensitive recording material in Example 1 was repeated except that there was no addition of the fluorescent brightening agent in the thermosensitive coloring layer coating liquid and the Liquid D used in formation of the protective layer in Example 1 was replaced by a Liquid E with the following formulation:

| (Liquid E) | parts by weight |
|---|---|
| 10% aqueous solution of polyvinyl alcohol | 63 |
| polyamide-epichlorohydrin resin (solid content 25%) | 10 |
| BLANKOPHOR Z-PSG (solid content 1%) | 13 |
| silica | 3 |
| zinc stearate | 1 |
| water | 10 |

Thus, a thermosensitive recording material of the present invention was obtained.

Example 3

The procedure for preparation of the thermosensitive recording material in Example 2 was repeated except that the Liquid E used in formation of the protective layer in Example 2 was replaced by a Liquid F with the following formulation:

| (Liquid-F) | parts by weight |
|---|---|
| 10% aqueous solution of polyvinyl alcohol | 63 |
| polyamide-epichlorohydrin resin (solid content 25%) | 10 |
| BLANKOPHER Z-PSG (solid content 1%) | 3 |
| silica | 3 |
| zinc stearate | 1 |
| water | 20 |

Example 4

The procedure for preparation of the thermosensitive recording material in Example 1 was repeated except that there was no addition of the Liquid C and the fluorescent brightening agent in the thermosensitive coloring layer coating liquid and the Liquid D used in formation of the protective layer in Example 1 was replaced by a liquid G with the following formulation:

| (Liquid G) | parts by weight |
|---|---|
| 10% aqueous solution of polyvinyl alcohol | 63 |
| polyamide-epichlorohydrin resin (solid content 25%) | 10 |
| BLANKOPHOR Z-SPG (solid content 1%) | 13 |
| Liquid C | 10 |
| silica | 3 |
| zinc stearate | 1 |

Example 5

The procedure for preparation of the thermosensitive recording material in Example 1 was repeated except that there was no addition of Liquid C in the thermosensitive coloring layer coating liquid and the Liquid D used in formation of the protective layer in Example 1 was replaced by a Liquid H with the following formulation:

| (Liquid H) | parts by weight |
|---|---|
| 10% aqueous solution of polyvinyl alcohol | 63 |
| polyamide-epichlorohydrin (solid content 25%) | 10 |
| Liquid C | 10 |
| silica | 3 |
| zinc stearate | 1 |
| water | 13 |

Example 6

The procedure for preparation of the thermosensitive recording material in Example 1 was repeated except that the Liquid A, Liquid B, Liquid C, and 1% aqueous solution of the fluorescent brightening agent, 4,4'-diamino stilbene-2,2'-disulfonic acid derivatives (BLANKOPHOR Z-PSG) were mixed at a weight ratio of 1:8:1:0.2.

Example 7

The procedure for preparation of the thermosensitive coloring layer coating liquid in Example 1 was repeated except that zinc stearate was mixed with stirring at a weight ratio of Liquid A, Liquid B, Liquid C, BLANKOPHOR Z-SPG, and zinc stearate was 1:8:1:0.4:0.1. This thermosensitive coloring layer coating liquid was coated on a sheet of commercially available woodfree paper with a basis weight of 50 g/m$^2$, serving as a substrate, in a coating amount of 7 g/m$^2$ on a dry basis, and dried. Furthermore, the surface of thus prepared thermosensitive coloring layer was subjected to calendering under the condition of a pressure of 20 kg/cm$^2$ so as to have a smooth surface.

Comparative Example 1

The procedure for preparation of the thermosensitive recording material in Example 2 was repeated except that the Liquid E used in formation of the protective layer was replaced by a Liquid D. Thus, a comparative thermosensitive recording material was obtained.

Comparative Example 2

The procedure for preparation of the thermosensitive recording material in Example 4 was repeated except that the Liquid G used in formation of the protective layer was replaced by a Liquid H.

Comparative Example 3

The procedure for preparation of the thermosensitive recording material in Example 4 was repeated except that the component (I) used in the Liquid C included in the Liquid G was replaced by 2,4-dihydroxy benzophenone.

Comparative Example 4

The procedure for preparation of the thermosensitive recording material in Example 4 was repeated except that the component (I) used in the Liquid C included in the Liquid G was replaced by 2-(2,'-hydroxy-5'-methylphenyl) benzotriazole.

In accordance with the following methods, each of the thermosensitive recording materials according to the present invention obtained in Examples from 1 through 7 and comparative thermosensitive recording materials in Comparative Examples 1 through 4 were evaluated with respect to the light resistance and the stability of each coating liquid.

The results are given in table 1 and 2.

(1) Light resistance test

The coated side of each thermosensitive recording material was exposed to the light for 15 hours under the condition of 0.35 W/m$^2$ (340 nm) using Xenon weathering tester ATLAS Ci 35A manufactured by Toyo Seiki Co., Tokyo, JAPAN.

After 15 hours light exposure, the optical density of each light-exposed area was measured with the reflection densitometer Macbeth RD-914 using blue filter. The optical density of the coated side of each thermosensitive recording material before light exposure was also measured.

(2) Stability of coating liquid

Each prepared coating liquid for the thermosensitive coloring layers and the protective layers was allowed to stand at 20° C. for one day by stirring. The liquids were then evaluated as follows:

X: There were large increase in viscosity and clear layer separation of coating liquid.

Δ: There were slight increase in viscosity and vague layer separation of coating liquid.

○: There were slight increase in viscosity and no layer separation of coating liquid.

⊙: There were no increase in viscosity and no layer separation of coating liquid.

TABLE 2-continued

| | Light resistance test | | Stability of coating liquid | |
|---|---|---|---|---|
| | Optical density before test | Optical density after test | Thermo-sensitive coloring layer coating liquid | Protective layer coating liquid |
| Example 3 | 0.10 | 0.20 | ⊙ | ⊙ |
| Example 4 | 0.16 | 0.18 | ○ | ⊙ |
| Example 5 | 0.14 | 0.17 | ○ | ○ |
| Example 6 | 0.13 | 0.23 | ⊙ | ○ |
| Example 7 | 0.14 | 0.25 | ⊙ | — |
| Comparative example 1 | 0.20 | 0.31 | ⊙ | ○ |
| Comparative example 2 | 0.22 | 0.28 | ○ | ○ |
| Comparative example 3 | 0.19 | 0.35 | X | Δ |
| Comparative example 4 | 0.18 | 0.40 | X | X |

TABLE 1

| | Ultraviolet stabilizer | | Fluorescent brightening agent | |
|---|---|---|---|---|
| | Component | Layer to be added | Content | Layer to be added |
| Example 1 | 2-(2-hydroxy-3-tert-butyl-5-methylphenyl)-5-chlorobenzotriazol | Thermosensitive coloring layer | 0.02 parts by weight per 1 part by weight of the leuco dye | Thermosensitive coloring layer |
| Example 2 | Same as Example 1 | Same as Example 1 | 0.02 parts by weight per 1 part by weight of the organic polymer | Protective layer |
| Example 3 | Same as Example 1 | Same as Example 1 | 0.005 parts by weight per 1 part by weight of the organic polymer | Same as Example 2 |
| Example 4 | Same as Example 1 | Protective layer | Same as Example 2 | Same as Example 2 |
| Example 5 | Same as Example 1 | Same as Example 4 | Same as Example 1 | Same as Example 1 |
| Example 6 | Same as Example 1 | Same as Example 1 | 0.005 parts by weight per 1 part by weight of the leuco dye | Same as Example 1 |
| Example 7 | Same as Example 1 | Same as Example 1 | Same as Example 1 | Same as Example 1 |
| Comparative example 1 | Same as Example 1 | Same as Example 1 | Non | — |
| Comparative example 2 | Same as Example 1 | Same as Example 4 | Non | — |
| Comparative example 3 | 2,4-dihydroxy-benzophenone | Same as Example 1 | Same as Example 1 | Same as Example 1 |
| Comparative example 4 | 2-(2'-dihydroxy-5'-methylphenyl)-benzotriazol | Same as Example 4 | Same as Example 2 | Same as Example 2 |

TABLE 2

| | Light resistance test | | Stability of coating liquid | |
|---|---|---|---|---|
| | Optical density before test | Optical density after test | Thermo-sensitive coloring layer coating liquid | Protective layer coating liquid |
| Example 1 | 0.14 | 0.24 | ⊙ | ○ |
| Example 2 | 0.10 | 0.19 | ⊙ | ○ |

As may be observed from in the Tables, the thermosensitive recording materials of the present invention maintain a high whiteness degree of the background when exposed to light, and the production method for producing a thermosensitive recording material of the present invention affords coating liquids existing good stability in comparison with those of the comparative examples.

Having described the present invention, it will be apparent to the artisan that many changes and modifications may be made to the above-described embodiments with departing from the spirit and scope of the present invention.

What is claimed as new and desired to be secured by Letters Patent of the United States is:

1. A thermosensitive recording material, comprising a substrate and a thermosensitive coloring layer, formed on said substrate, said thermosensitive coloring layer comprising a leuco dye and a coloring developer for inducing color formation in said leuco dye upon application of heat thereto, wherein said thermosensitive coloring layer comprises an ultraviolet stabilizer, comprising 2-(2-hydroxy-3-tert-butyl-5-methylphenyl)-5-chlorobenzotriazole, and a fluorescent brightening agent, comprising one or more 4,4'-diamino stilbene-2,2'-disulfonic acid compounds.

2. A thermosensitive recording material, comprising a substrate and a thermosensitive coloring layer, formed on said substrate, said thermosensitive coloring layer comprising a leuco dye and a coloring developer for inducing color formation in said leuco dye upon application of heat thereto, and a protective layer, formed on said thermosensitive coloring layer, comprising an organic polymer, wherein an ultraviolet stabilizer, comprising 2-(2-hydroxy-3-tert-butyl-5-methylphenyl)-5-chlorobenzotriazole, and a fluorescent brightening agent, comprising one or more 4,4'-diamino stilbene-2,2'-disulfonic acid compounds, are each included in at least one of said thermosensitive coloring layer or said protective layer, or both are included in one of said thermosensitive coloring layer or said protective layers, or both are included in at least one of said thermosensitive coloring layer or said protective layer and one of each is included in the other of said layers.

3. The thermosensitive recording material of claim 1 or 2, wherein the weight ratio of said fluorescent brightening agent to said leuco dye is about 0.01 or less in said thermosensitive coloring layer.

4. The thermosensitive recording material of claim 2, wherein the weight ratio of said fluorescent brightening agent to said organic polymer is about 0.01 or less in said protective layer.

5. The thermosensitive recording material of claim 1 or 2, wherein said one or more 4,4'-diamino stilbene-2,2'-disulfonic acid compounds have the formula (II):

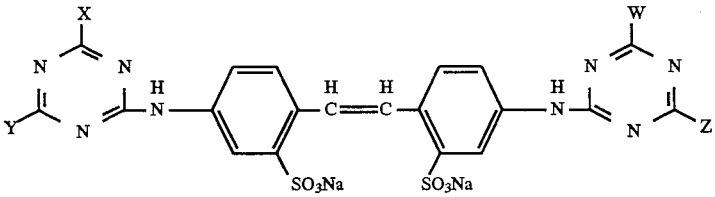

(II)

wherein each of W, X, Y and Z are independently selected from the group consisting of

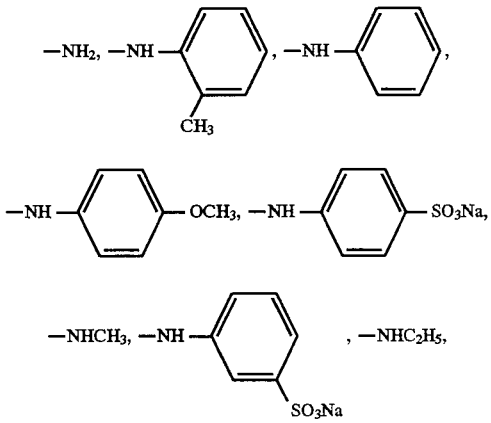

-continued

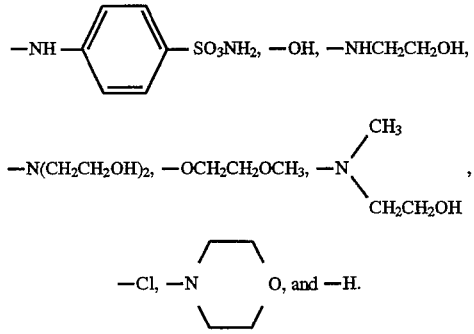

6. The thermosensitive recording material of claim 1 or 2, wherein said ultraviolet stabilizer is present in an amount of from about 0.1 to 5 parts by weight per 1 part by weight of said leuco dye in said thermosensitive coloring layer, and from about 0.01 to 1 part by weight per 1 part by weight of said organic polymer in said protective layer.

7. The thermosensitive recording material of claim 6, wherein said ultraviolet stabilizer is present in an amount of from about 0.2 to 2 parts by weight per 1 part by weight of said leuco dye in said thermosensitive coloring layer, and from about 0.01 to 0.5 parts by weight per 1 part by weight of said organic polymer in said protective layer.

8. The thermosensitive recording material of claim 1 or 2, which further comprises a filler.

9. The thermosensitive recording material of claim 1 or 2, which further comprises a thermofusible material.

10. The thermosensitive recording material of claim 2, wherein said organic polymer of said protective layer is a water-soluble resin.

11. The thermosensitive recording material of claim 10, wherein said protective layer further contains a waterproof agent selected from the group consisting of formaldehyde, glyoxal, chrome alum, melamine, melamine-formaldehyde resin, polyamide resin, and polyamide-epichlorohydrin resin.

12. The thermosensitive recording material of claim 1 or 2, wherein said leuco dye is selected from the group consisting of triphenylmethane-based leuco compounds, fluoran-based leuco compounds, phenothiazine-based leuco compounds, auramine-based leuco compounds, spiropyran-based leuco compounds and indolinophthalide-based leuco compounds.

13. The thermosensitive recording material of claim 10, wherein said protective layer further comprises one or more waterproof agents which react with said water-soluble resin to form a waterproof protective layer.

14. A process for producing a thermosensitive recording material forming on a substrate a thermosensitive coloring layer, comprising coating and drying an aqueous coating liquid including a leuco dye and a coloring developer for inducing color formation in said leuco dye upon application of heat thereto, and a binder, wherein said coating liquid comprises an ultraviolet stabilizer comprising 2-(2-hydroxy- 3-tert-butyl-5-methylphenyl)-5-chlorobenzotriazole and a fluorescent brightening agent comprising one or more 4,4'-diamino stilbene-2,2'-disulfonic acid compounds.

15. A process for producing a thermosensitive recording material forming on a substrate a thermosensitive coloring layer, comprising coating and drying an aqueous coating liquid including a leuco dye and a coloring developer for inducing color formation in said leuco dye upon application of heat thereto, and a binder, and forming on said thermosensitive coloring layer a protective layer, comprising coating and drying a coating liquid comprising an organic polymer, wherein and ultraviolet stabilizer comprising 2-(2-hydroxy-3-tert-butyl-5-methylphenyl)-5-chlorobenzotriazole and a fluorescent brightening agent comprising one or more 4,4'-diamino stilbene-2,2'-disulfonic acid compounds are included in at least one of a thermosensitive coloring layer coating liquid and a protective layer coating liquid.

16. The process of claim 14 or 15, wherein the weight ratio of said fluorescent brightening agent to said leuco dye is about 0.01 or less in the coating liquid for said thermosensitive coloring layer.

17. The process of claim 15, wherein the weight ratio of said fluorescent brightening agent to said organic polymer is about 0.01 or less in the coating liquid for said protective layer.

18. The process of claim 14 or 15, wherein said one or more 4,4'-diamino stilbene-2,2'-disulfonic acid compounds have the formula (II):

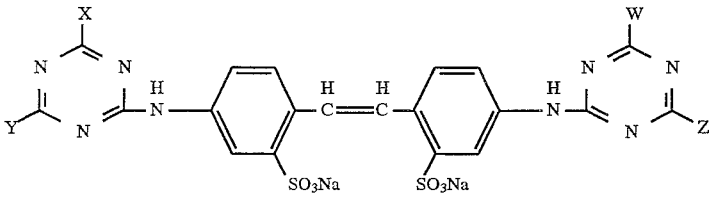

(II)

wherein each of W, X, Y and Z are independently selected from the group consisting of

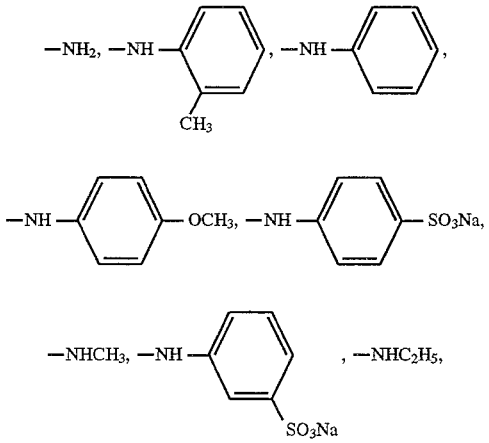

-continued

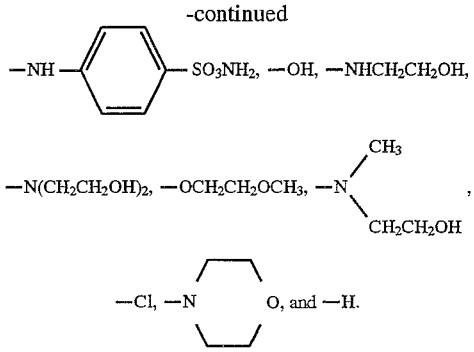

19. The process of claim 14 or 15, wherein said ultraviolet stabilizer is present in an amount of from about 0.1 to 5 parts by weight per 1 part by weight of said leuco dye in said thermosensitive coloring layer, and from about 0.01 to 1 part by weight per 1 part by weight to said organic polymer in the coating liquid for said protective layer.

20. The process of claim 19, wherein said ultraviolet stabilizer is present in an amount of from about 0.2 to 2 parts by weight per 1 part by weight of said leuco dye in said thermosensitive coloring layer, and from about 0.1 to 0.5 parts by weight per 1 part by weight of said organic polymer in the coating liquid for said protective layer.

21. The process of claim 14 or 15, in which the coating layer for said thermosensitive coloring layer or for said protective layer further comprises a filler.

22. The process of claim 14 or 15, in which the coating layer for said thermosensitive coloring layer or for said protective layer further comprises a thermofusible material.

23. The process of claim 15, wherein said organic polymer of the coating layer for said protective layer is a water-soluble resin.

24. The process of claim 23, wherein the coating layer for said protective layer further contains one or more waterproof agents selected from the group consisting of formaldehyde, glyoxal, chrome alum, melamine, melamine-formaldehyde resin, polyamide resin and polyamide-epichlorohydium resin.

* * * * *